US006220061B1

(12) United States Patent
Ando et al.

(10) Patent No.: US 6,220,061 B1
(45) Date of Patent: Apr. 24, 2001

(54) SLIDER FOR DOUBLE-CYLINDER CIRCULAR KNITTING MACHINES

(75) Inventors: Jan Ando; Giuseppe Caccivio, both of Scandicci (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/454,440

(22) Filed: Dec. 3, 1999

(30) Foreign Application Priority Data

Dec. 9, 1998 (IT) ..... MI98A02645

(51) Int. Cl.[7] ..... D04B 9/10
(52) U.S. Cl. ..... 66/14; 66/123; 66/18
(58) Field of Search ..... 66/7, 8, 13, 17, 66/18, 116, 123, 14

(56) References Cited

U.S. PATENT DOCUMENTS 3,678,710 * 7/1972 Gostelow ..... 66/14
4,073,163 * 2/1978 Lonati ..... 66/14
4,541,253 * 9/1985 Luchi et al. ..... 66/14
5,275,021 * 1/1994 Fucik ..... 66/14
5,367,893 * 11/1994 Fucik ..... 66/14

* cited by examiner

*Primary Examiner*—Danny Worrell
(74) *Attorney, Agent, or Firm*—Welsh & Katz, Ltd.

(57) ABSTRACT

A slider for double-cylinder circular knitting machines which comprises an elongated laminar body which has a first longitudinal side which is meant to be rested on the bottom of an axial slot formed in the curved surface of the lower needle cylinder or in the curved surface of the upper needle cylinder and at least two heels which protrude transversely to the longitudinal extension of the laminar body on the second longitudinal side of the laminar body that lies opposite the first side. The laminar body has, proximate to one of its longitudinal ends, a hook for engagement with a needle. A first one of the two heels is arranged on a portion of the laminar body which can move with respect to the remaining part of the laminar body in a direction which has a component which is transverse with respect to the longitudinal extension of the laminar body for the transfer of the first heel from an inactive position to an active position, or viceversa. The first heel is spaced from the first side of the laminar body more in the active position than in the inactive position.

5 Claims, 4 Drawing Sheets

SLIDER FOR DOUBLE-CYLINDER CIRCULAR KNITTING MACHINES

BACKGROUND OF THE INVENTION

The present invention relates to a slider for double-cylinder circular knitting machines, particularly for hosiery knitting.

It is known that double-cylinder circular hosiery knitting machines generally comprise a lower needle cylinder and an upper needle cylinder which are mutually coaxial and can be actuated rigidly together with a rotary motion about their common axis.

In the skirt or curved surface of the lower needle cylinder and in the skirt or curved surface of the upper needle cylinder a plurality of axial slots are provided. The axial slots of the upper needle cylinder are aligned with the slots formed in the curved surface of the lower needle cylinder. Each one of the axial slots of the lower needle cylinder generally accommodates, starting from below, a selector and a slider, whereas each one of the axial slots of the upper needle cylinder accommodates a slider. Between the two needle cylinders, i.e., in the knitting region, in each one of the axial slots there is a needle which has two tips, respectively an upper tip and a lower tip; depending on whether plain stitches or purl stitches are to be produced, said needle is moved into the lower needle cylinder so that it knits with its upper tip or into the lower needle cylinder so that it knits with its lower tip.

Since the needle does not have a heel, it is actuated by means of the slider located in the lower needle cylinder or by means of the slider arranged in the upper needle cylinder depending on whether it is meant to form plain or purl stitches.

The sliders currently used in double-cylinder circular hosiery knitting machines are generally constituted by an elongated laminar body which has a first longitudinal side which is meant to rest on the bottom of the axial slot formed in the curved surface of the lower needle cylinder or in the curved surface of the upper needle cylinder.

Said sliders are further provided with two heels which are mutually spaced along the longitudinal extension of the slider and protrude transversely from a second longitudinal side of the slider which lies opposite the first side.

Said heels are used to move the slider along the corresponding axial slot of the lower needle cylinder or upper needle cylinder, so as to produce the actuation of the needle that is associated with said slider in the various knitting processes of the machine.

The slider furthermore has on its first longitudinal side, i.e., on its side directed toward the bottom of the axial slot inside which it is accommodated, a hook which engages the lower or upper tip of the needle, depending on whether the slider is in the lower needle cylinder or in the upper needle cylinder.

A plurality of cams are arranged around the curved surface of the lower needle cylinder and around the curved surface of the upper needle cylinder and form a series of paths with which the heels of the sliders engage when the needle cylinders are actuated so as to rotate about their axis with respect to said cams. The paths formed by the cams are shaped so as to produce the movement of the sliders along the axial slots of the needle cylinders in which they are accommodated and accordingly produce the actuation of the needles associated therewith.

In currently commercially available double-cylinder circular hosiery knitting machines, many of the cams that determine the paths for the heels of the sliders are provided so that they can move in a radial direction with respect to the needle cylinders, so that they can be transferred from an active position, in which they are close to the needle cylinders so that they can be engaged by the heels of the sliders, to an inactive position, in which they are spaced from the needle cylinders so as to avoid interfering with the heels of the sliders, or viceversa, so as to allow to produce different kinds of knitting.

The presence of these movable cams, which is required in order to perform the different kinds of knitting, entails the problem that it considerably increases the complexity of the structure of the entire machine.

Furthermore, the presence of these movable cams forces the provision, on board the machine, of a specific actuation program which intervenes if an accidental stoppage of the machine occurs due to a power failure; said program restores the correct position of the movable cams before knitting resumes, because if the machine were to restart without first restoring the correct position of the movable cams, the heels of the sliders might break.

In practice, the presence of these movable cams makes it necessary to provide the machine with electronic programs which store the position of the movable cams when the power failure occurred, and this constitutes a further complication in the execution of the machine.

SUMMARY OF THE INVENTION

The aim of the present invention is to solve the above problems, providing a slider for double-cylinder circular hosiery knitting machines which allows to significantly reduce the number of movable cams required for its actuation.

Within the scope of this aim, an object of the invention is to provide a slider which allows to considerably simplify the set of cams required for its actuation.

Another object of the invention is to provide a slider which, despite a simplification of the cams required for its actuation, nonetheless allows to perform the usual knitting processes that are possible in conventional types of double-cylinder circular hosiery knitting machine.

This aim, these objects and others which will become apparent hereinafter are achieved by a slider for double-cylinder circular hosiery knitting machines, comprising an elongated laminar body which has a first longitudinal side which is meant to be rested on the bottom of an axial slot formed in the curved surface of the lower needle cylinder or in the curved surface of the upper needle cylinder and at least two heels which protrude transversely to the longitudinal extension of said laminar body on a second longitudinal side of the laminar body which lies opposite said first side; said laminar body having, proximate to one of its longitudinal ends, means for engagement with a needle, characterized in that a first one of said two heels is arranged on a portion of said laminar body which can move with respect to the remaining part of said laminar body in a direction which has a component which is transverse with respect to the longitudinal extension of said laminar body for the transfer of said first heel from an inactive position to an active position, or viceversa; said first heel being spaced from said first side more in said active position than in said inactive position.

BRIEF DESCRIPTION OF THE DRAWINGS

Further characteristics and advantages of the present invention will become apparent from the following detailed description of two preferred but not exclusive embodiments of the slider according to the invention, illustrated only by way of non-imitative example in the accompanying drawings, wherein.

DESCRIPTION OF THE PREFERRED EMBODIMENTS

Figure 2:
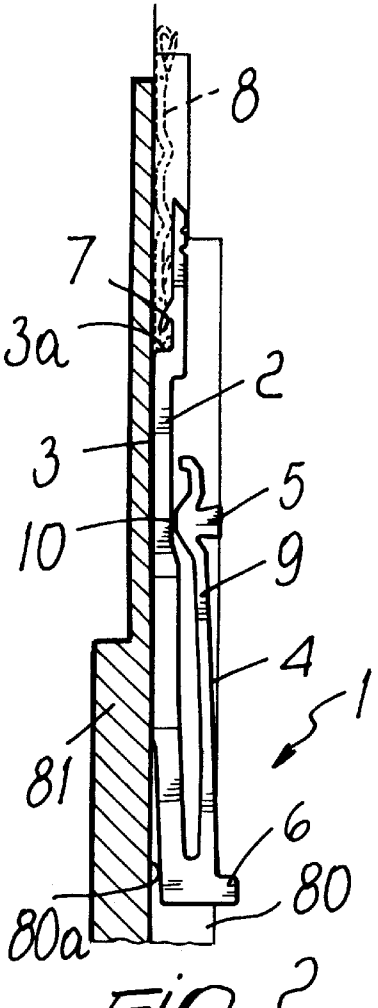
FIG. 2 is a view of the slider according to the invention in the first embodiment, with the first heel in the inactive position and inserted in the lower needle cylinder.
Figure 1:
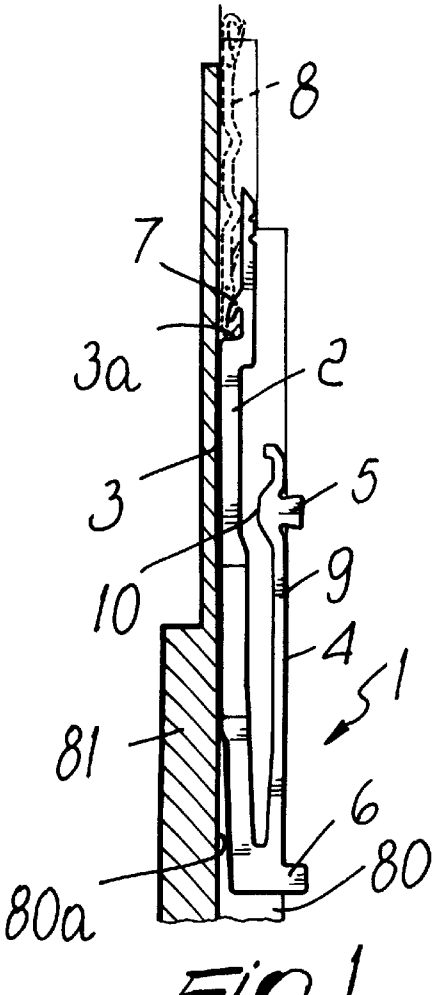
FIG. 1 is a view of the slider according to the invention, in the first embodiment, with the first heel in the active position and inserted in the lower needle cylinder.

With reference to FIGS. 1 and 2, the slider according to the invention, in the first embodiment, generally designated by the reference numeral 1, comprises an elongated laminar body 2 which has a first longitudinal side 3, meant to rest on the bottom 80*a* of the axial slot 80 of the needle cylinder 81 in which it is inserted, and a second longitudinal side 4, which lies opposite with respect to the first longitudinal side 3.

The slider is provided with a first heel 5 and with a second heel 6 which are mutually spaced along the longitudinal extension of the laminar body 2 and run transversely to the longitudinal extension of the laminar body 2 on the second side 4.

According to the invention, the first heel 5 is arranged on a portion of the laminar body 2 which can move with respect to the remaining part of the laminar body 2 in a direction which has a component which is transverse with respect to the longitudinal extension of the laminar body in order to allow the transfer of the first heel 5 from an inactive position to an active position or viceversa. In the active position, the first heel 5 is spaced from the first side 3 of the laminar body 2 more than in the inactive position.

Proximate to one of its longitudinal ends, the laminar body 2 is provided, on its first longitudinal side 3, with means 7 for engaging the needle 8 that is located in the same slot 80 of the lower or upper needle cylinder 81.

Said engagement means 7 are constituted by a hook which is provided at a suitable seat 3a which is formed starting from a longitudinal end of the laminar body 2 and in which it is possible to accommodate the lower or upper portion of the needle 8 depending on whether the slider is in the lower needle cylinder or in the upper needle cylinder.

The first heel 5 is preferably constituted by the heel that lies closest to the longitudinal end of the laminar body 2 which can engage the needle 8.

In the first embodiment, shown in FIGS. 1 and 2, the first heel 5 is associated, preferably monolithically, with a portion 9 of the laminar body 2 which can flex elastically on the plane of arrangement of the laminar body 2 with respect to the remaining part of the laminar body 2.

More particularly, the portion 9 is preferably formed monolithically with the remaining part of the laminar body 2 and extends from it starting from a region which is proximate to the longitudinal end of the laminar body 2 that lies opposite with respect to the end of said body that can engage the needle 8.

The second heel 6, located proximate to the longitudinal end of the laminar body 2 that lies opposite the end that can engage the needle 8, is preferably rigidly coupled to the remaining part of the laminar body 2.

The portion 9 has, on the opposite side with respect to the first heel 5, a resting region 10 which can be engaged against the remaining part of the laminar body 2 in the flexing of the portion 9, so as to delimit the movement of the first heel 5 transversely to the longitudinal extension of the laminar body 2 in its transfer from the active position to the inactive position, as shown in particular in FIG. 2.

Figure 4:
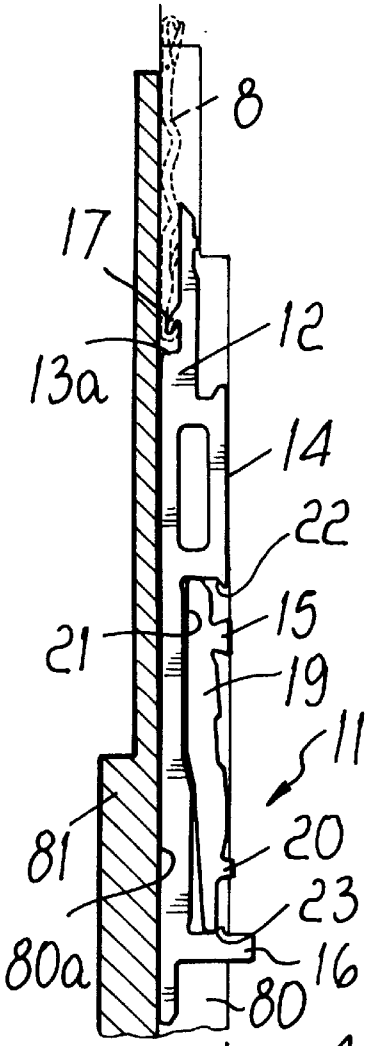
FIG. 4 is a view of the slider according to the invention in the second embodiment, with the first heel in the inactive position and inserted in the lower needle cylinder.
Figure 3:
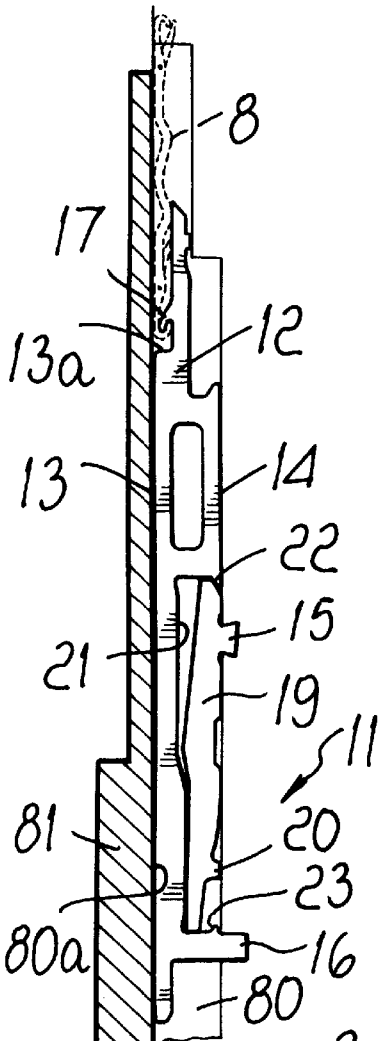
FIG. 3 is a view of the slider according to the invention in the second embodiment, with the first heel in the active position and inserted in the lower needle cylinder.

The slider according to the invention, in the second embodiment, shown in particular in FIGS. 3 and 4 and generally designated by the reference numeral 11, also comprises an elongated laminar body 12 which has a first longitudinal side 13 which is meant to rest against the bottom 80*a* of the axial slot 80 of the lower or upper needle cylinder 81, in which it is to be accommodated, and a second longitudinal side 14 which lies opposite the first longitudinal side 13.

In this embodiment also, the slider 11 is provided, proximate to one of its longitudinal ends, with means 17 for engagement with a needle 8.

Said engagement means 17 are constituted, as in the first embodiment, by a hook which can engage the lower or upper tip of the needle 8 and is formed in a suitable seat 13a which is provided on the side 13 of the laminar body 12 starting from its longitudinal end which is meant to be directed toward the needle 8. The seat 13a is meant to receive the lower portion or the upper portion of the needle 8, depending on whether the slider is accommodated in the lower needle cylinder or in the upper needle cylinder.

The laminar body 12 is provided with a first heel 15 and with a second heel 16 which run transversely to the longitudinal extension of the laminar body 2 on the second longitudinal side 14.

The second heel 16, located proximate to the longitudinal end of the laminar body 12 that lies opposite the end that can engage the needle 8, is preferably rigidly coupled to the remaining part of the laminar body 12.

In this embodiment, the first heel 15 is fitted on a portion 19 which can oscillate with respect to the remaining part of the laminar body 12 in order to allow the transfer of the first heel 15 from an inactive position, in which it is close to the second side 13, to an active position, in which it is further spaced from the first longitudinal side 13 than in the inactive position, or viceversa.

Preferably, in this embodiment also the first heel 15 of the two heels 15 and 16, is the one nearest to the end of the laminar body 12 that can engage the needle 8.

The oscillating portion 19 is pivoted to the remaining part of the laminar body 12 at an intermediate portion. The pivoting can be achieved, as shown, by means of a particular geometric configuration of the sides of the portion 19 and of the remaining part of the laminar body 12 which are in mutual contact.

The first heel 15 is located proximate to the end of the oscillating portion 19 that lies closest to the end of the laminar body 12 that can engage the needle 8, and proximate to the other end of the oscillating portion 19, which lies proximate to the second heel 16, an actuation lug 20 is provided which can be contacted to produce the oscillation of the oscillating portion 19 in the transfer of the first heel 15 from the inactive position to the active position, as will become apparent hereinafter.

The laminar body 12 of the slider, in the second embodiment, is provided with means for delimiting the oscillation angle of the oscillating portion 19 with respect to the remaining part of the laminar body 12.

Said delimiting means comprise a seat 21 which is formed on the second longitudinal side 14 of the laminar body 12; the oscillating portion 19 is arranged in said seat 21. The seat 21 is delimited, along a direction which is parallel to the longitudinal extension of the laminar body 12, by two sides located proximate to the ends of the oscillating portion 19. On these two sides there are shoulders 22 and 23 which are engaged respectively by one end of the oscillating portion 19 when the heel 15 is moved into the active position and by the other end of the oscillating portion 19 when the first heel 15 is moved into the inactive position, thus limiting the breadth of the oscillation allowed to the oscillating portion 19.

In the first embodiment and in the second embodiment, when the first heel 15 is in the active position it protrudes from the slot 80 of the needle cylinder 81 and can engage at least some of the slider actuation cams that surround the needle cylinder and will be described in greater detail hereinafter, whereas when it is in the inactive position it is recessed in the slot 80 of the needle cylinder so as to avoid engaging said cams.

When the first heel 15 is in the active position, the actuation lug 20 is located inside the slot 80, whereas when the first heel 15 is in the inactive position said lug protrudes from the slot 80 and can engage at least some of the slider actuation cams that face the needle cylinder and will be described in greater detail hereinafter.

The operation of the slider according to the invention is now described with reference to FIGS. 5, 6 and 7, which illustrate, merely by way of example, a possible configuration of the slider actuation cam set as regards the lower needle cylinder 81.

As shown in these figures, the cams comprise a fixed upper cam 30 which has, along its lower edge, regions designated by the reference numerals 31 to 36 which are shaped like an inclined plane and can be contacted by the first heel 15. Said regions 31–36 produce the transfer of said heel 15 from the active position to the inactive position or allow its transfer from the inactive position to the active position.

The actuation cams for the first heel 15 further comprise a first lifting cam 37, two mutually opposite lowering cams, designated by the reference numerals 38 and 39 respectively, which are provided at a first feed or drop of the machine, and a lowering cam 40, which is provided at a second feed or drop of the machine. The actuation cams for the first heel 15 are completed by two lifting cams 41 and 42 which are arranged consecutively with respect to each other at the feed or drop proximate to the lowering cam 40.

The actuation cams for the second heel 16 comprise a fixed cam 50 which runs entirely around the needle cylinder and further cams which are designated by the reference numerals 51 to 54.

In addition to the cams, around the needle cylinders there are suitable guiding elements which are arranged at a level which is adapted to make contact with the actuation lug 20 in order to produce the oscillation of the oscillating portion 19 and therefore produce the transfer of the first heel 15 from the inactive position to the active position. In FIGS. 5, 6 and 7, said guiding element have been designated by the reference numerals 71, 72, 73 and 74.

Figure 5:
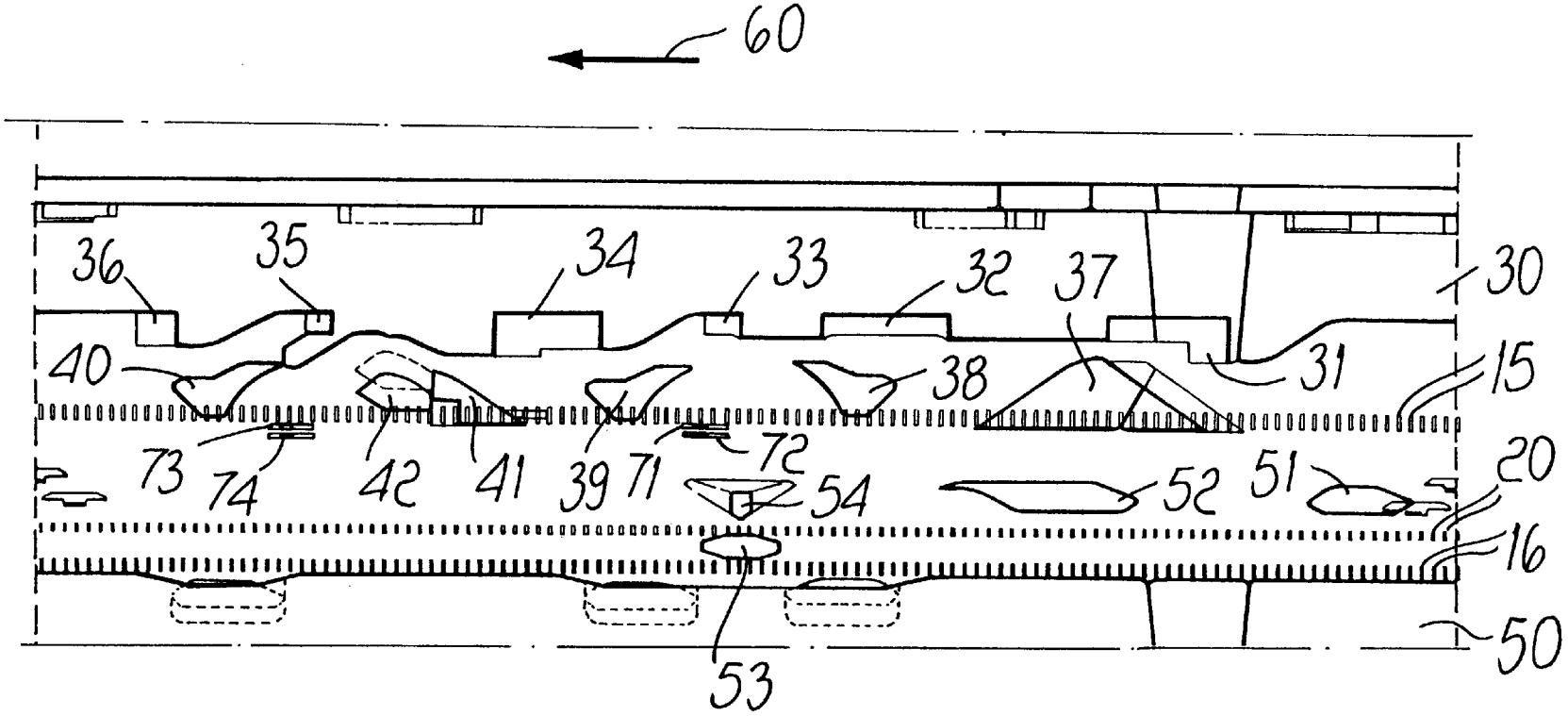
FIG. 5 is a schematic view, projected onto a plane, of the set of slider actuation cams in the second embodiment, illustrating the path of the heels of the slider when the corresponding needle must be prevented from knitting.
Figure 6:
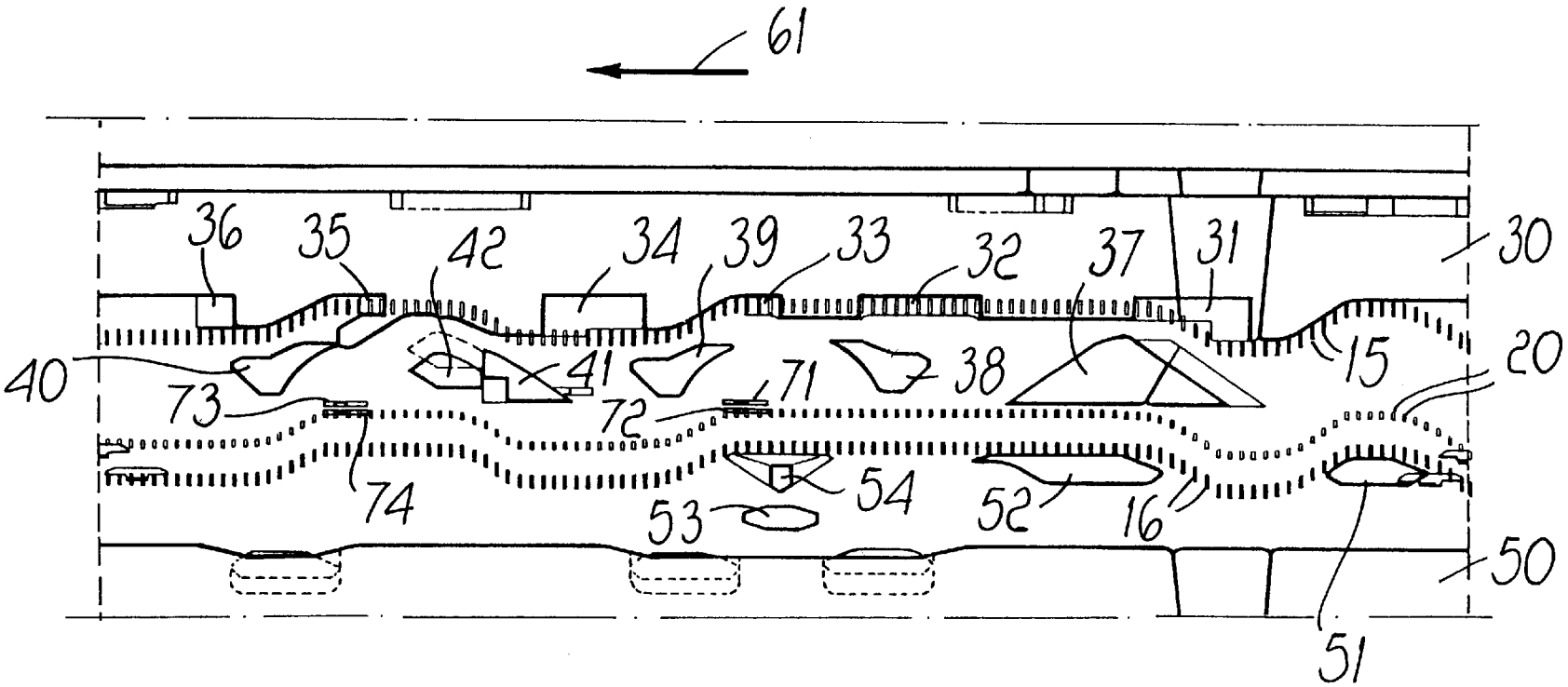
FIG. 6 is a schematic view, projected onto a plane, of the set of slider actuation cams in the second embodiment, illustrating the path of the heels of the slider during the transfer of the corresponding needle from the lower needle cylinder to the upper needle cylinder.
Figure 7:
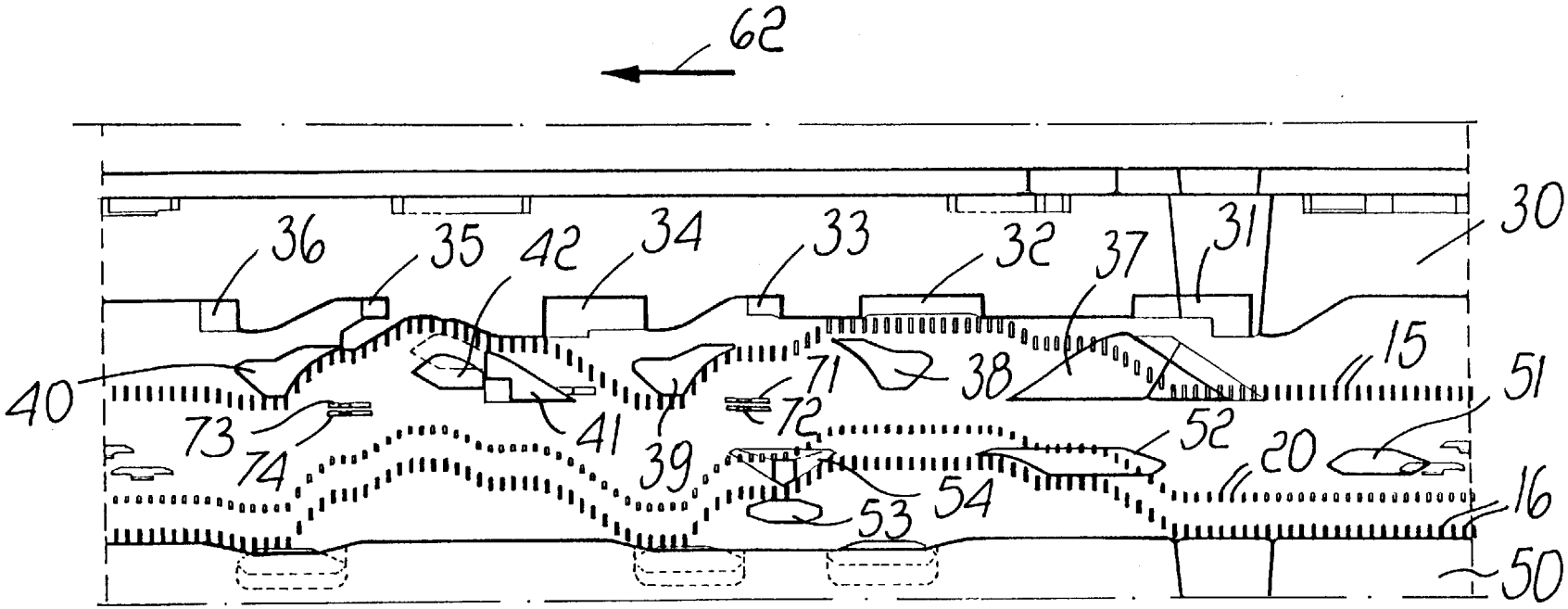
FIG. 7 is a schematic view, projected onto a plane, of the set of slider actuation cams in the second embodiment, illustrating the path of the heels of the slider in the actuation of the corresponding needle for producing drop stitches at two feeds of the machine.

In FIGS. 5, 6 and 7, the first heel 15 is represented by a rectangle which is black when the first heel 15 is in the active position and is instead white when said heel 15 is in the inactive position. The same rule has been adopted for the actuation lug 20, which is represented by a black rectangle when it protrudes from the needle cylinder and by a white rectangle when it is instead recessed in the slot 80 of the needle cylinder.

FIG. 5 illustrates the path followed by the heels 15 and 16 and by the actuation lug 20 of the slider 11 when the corresponding needle 8 must be excluded from knitting at the two feeds of the machine; the movement of the slider 11 with respect to the set of cams for its actuation is designated by the arrow 60.

In this operating condition, the first heel 15 is in the inactive position. In this condition, the slider 11 is not moved along the corresponding slot 80 of the needle cylinder 81 in which it is inserted and the first heel 15 can move without interference beyond the cams 37, 38, 39, 41, 42 and 40 since it is in the inactive position.

It should be observed that due to this fact the cam 38, which can usually move in a radial direction with respect to the needle cylinder, can be provided as a fixed cam and the lowering cams 39 and 40 also can be provided as fixed cams except, of course, for the possibility to move said cams, in a per se known manner, in a direction which is parallel to the axis of the needle cylinders in order to allow to vary the length of the loops of knitting.

It should also be observed that directly ahead of the cam 40 and of the cam 39 in the direction 60 is not necessary to provide lowering cams in order to move the first heel 15 below the lower edge of said lowering cams 39 and 40, as instead required by conventional machines, wherein the presence of said lowering cams applies unwanted stress to any loops of knitting engaged by the needle 8 associated with the slider. In the transfer of the needle from the lower cylinder to the upper cylinder, shown in FIG. 6, in which the direction of the movement of the slider with respect to the cams has been indicated by the arrow 61, the first heel 15 is initially, i.e., starting from the right side of FIG. 6, in the active position. The slider is lifted by other elements, constituted for example by selectors which are present in the same slot 80 below said slider, and is then lowered by the cam 30.

The slider is then raised by means of the selector or of other underlying elements and the first heel 15 engages the inclined-plane region 31 of the cam 30 that produces the transfer of the heel 16 from the active position to the inactive position. In this position, the slider, by means of other cams of a known type which are not described further for the sake of simplicity, disengages with its hook 7 from the lower tip of the needle which is engaged by the slider arranged in the upper cylinder. Then the actuation lug 20 engages against the guiding element 72, which produces the transfer of the first heel to the active position. The first heel 15 then engages a descending portion of the cam 30 which produces the lowering of the slider. The first heel 15 engages the portion 34 of the cam 30 that returns the first heel 15 to the inactive position. Said FIG. 6 illustrates the further lifting of the slider in the lower cylinder, directly ahead of the feed served by the lowering cam 40, in the direction indicated by the arrow 61, in order to open the tab of the needle that has been transferred into the upper needle cylinder. After this further lifting, the actuation lug 20 is contacted by the guiding element 74, which again causes the transfer of the first heel 15 into the active position, so that by engaging another descending portion of the cam 30 it produces the lowering of the slider.

FIG. 7 illustrates the path of the heels of the slider during the production of drop stitches with the needle associated therewith at the two feeds of the machine.

Ahead of the feed proximate to which the lowering cams 38 and 39 are provided, along the direction of motion of the slider with respect to the cams, designated by the arrow 62, the slider is lifted by the corresponding selector or other underlying element, whereas the first heel 15 is in the inactive position due to the contact of said heel with the cam 37.

As a consequence of the engagement of the actuation lug 20 with the cam 54, the first heel 15 is moved into the active position and, after the needle associated with the slider has engaged the thread at the feed being considered, the first heel 15 engages the lowering cam 39, which produces the lowering of the slider and therefore the retraction of the associated needle 8 into the lower needle cylinder in order to form new loops, lowering the previously formed loops.

The slider is then lifted again by the selector or other underlying element and is moved to a level which allows the needle 8 associated therewith to engage the thread at the next feed. Due to this lifting, the previously formed loops are lowered onto the shank of the needle.

Then the first heel 15, which is still in the active position, engages the lowering cam 40, which forms new loops and lowers the previously formed loops.

Downstream of the feed served by the lowering cam 40, the first heel 15 again engages the cam 37, which produces the transfer of the first heel 15 into the inactive position, and the cycle resumes as already described.

It should be observed that in this knitting process also the first heel 15 passes without any problem beyond the lowering cam 38, since said heel 15 is in the inactive position.

Although the operation of the slider according to the invention has been described with reference to its use in the lower needle cylinder of a two-feed machine, it is understood that the slider according to the invention can also be used in the upper needle cylinder and in machines having a different number of feeds.

In practice it has been observed that the slider according to the invention fully achieves the intended aim, since it allows to considerably simplify the slider actuation cams and to significantly reduce the number of cams that can move in a radial direction with respect to the needle cylinders.

The slider thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Application No. MI98A002645 from which this application claims priority are incorporated herein by reference.

What is claimed is:

1. A slider for a double-cylinder circular knitting machine, having lower and upper needle cylinders including curved surfaces thereof, axial slots formed in said curved surfaces, and a plurality of needles, the slider comprising: an elongated laminar body having a longitudinal extension between two opposite ends thereof, said elongated laminar body having a first longitudinal side arranged so as to be rested on a bottom part of a said axial slot formed in any of the curved surface of the lower needle cylinder and in the curved surface of the upper needle cylinder; at least two heels which protrude transversely to a longitudinal extension of said laminar body on a second longitudinal side of the laminar body which lies opposite of said first side; needle arrangement means, provided at said laminar body, proximate to a first one of said ends for engagement with a needle, wherein a first one of said two heels is arranged on a movable portion of said laminar body which is movable with respect to a remaining part of said laminar body in a direction which is transverse with respect to the longitudinal extension of said laminar body, movement of said laminar body movable portion determining transfer of said first heel from an inactive position to an active position, and from an active position to an inactive position, said first heel being spaced from said first side of the laminar body more in said active position than in said inactive position, said first hell being constituted by the one of the said two heels that lies closest to the end of said laminar body provided with said means for engaging the needle, said movable portion of said laminar body comprising a portion which is elastically flexible, in a plane of arrangement of said laminar body, with respect to said remaining part of said laminar body, said first heel being arranged on said flexible portion.

2. A slider of a double-cylinder circular knitting machine, having lower and upper needle cylinders including curved surfaces thereof, axial slots formed in said curved surfaces, and a plurality of needles, the slider comprising: an elongated laminar body having a longitudinal extension between two opposite ends thereof, said elongated laminar body having a first longitudinal side arranged so as to be rested on a bottom part of one of said axial slots formed in any of the curved surface of the lower needle cylinder and in the curved surface of the upper needle cylinder; at least two heels which protrude transversely to a longitudinal extension of said laminar body on a second longitudinal side of the laminar body which lies opposite to said first side; needle engagement means, provided at said lamninar body, proximate to a first one of said ends for engagement with a needle, wherein a first one of said two heels is arranged on a movable portion of said laminar body which is movable with respect to a remaining part of said laminar body in a direction which is transverse with respect to the longitudinal extension of said laminar body, movement of said laminar body movable portion determining transfer of said first heel from an inactive position to an active position, and from an active position to an inactive position, said first heel being spaced from said first of side of the laminar body more in said active position than in said inactive position, said first heel being constituted by the one of said two heels that lies closest to the end of said laminar body provided with said means for engaging the needle, said movable portion of said laminar body comprising an oscillating portion which oscillates on a plane of arrangement of said laminar body with respect to said remaining part of said laminar body, said first heel being arranged on said oscillating portion, the slider further comprising: an accommodation seat which is formed in said second side of said laminar body, said oscillating portion being arranged in said accommodation seat; and limiting means for delimiting an oscillation angle of said oscillating portion with respect to said remaining part of said laminar body, said oscillating portion having, on a side that bears said first heel, in a region which is spaced on the opposite side with respect to said first heel relative to a fulcrum of said oscillating portion, an actuation lug, said actuation lug being actuatable by contact to produce the oscillation of said oscillating portion for transfer of said first heel from said inactive position to said active position.

3. The slider of claim 2, wherein said first heel is arranged proximate to an end of said oscillating portion which lies closest to the one of said ends of said laminar body that engages the needle, said actuation lug being arranged proximate to the one of said ends of said oscillating portion that lies proximate to said second heel.

4. The slider of claim 1, wherein said second one of said two heels is rigidly coupled to said remaining part of the laminar body.

5. The slider of claim 2, wherein said second one of said two heels is rigidly coupled to said remaining part of the laminar body.

* * * * *